US009027855B2

(12) United States Patent
Nishimura

(10) Patent No.: US 9,027,855 B2
(45) Date of Patent: May 12, 2015

(54) SAFE PORTABLE SPRAYER

(76) Inventor: Takashi Nishimura, Sao Paulo (BR)

( * ) Notice: Subject to any disclaimer, the term of this patent is extended or adjusted under 35 U.S.C. 154(b) by 188 days.

(21) Appl. No.: 13/805,033

(22) PCT Filed: Apr. 24, 2012

(86) PCT No.: PCT/BR2012/000116
§ 371 (c)(1),
(2), (4) Date: Dec. 18, 2012

(87) PCT Pub. No.: WO2012/155224
PCT Pub. Date: Nov. 22, 2012

(65) Prior Publication Data

US 2013/0092751 A1 Apr. 18, 2013

(30) Foreign Application Priority Data

May 16, 2011 (BR) ..... 1102554

(51) Int. Cl.
*B05B 7/02* (2006.01)
*B05B 9/08* (2006.01)
*B05B 12/14* (2006.01)

(52) U.S. Cl.
CPC ..... *B05B 9/08* (2013.01); *B05B 9/0877* (2013.01); *B05B 12/1409* (2013.01)

(58) Field of Classification Search
CPC ..... B05B 12/002; B05B 15/061; B05B 7/12; B05B 15/065; B05B 7/0408; B05B 7/2424; B05B 7/2443; B05B 9/0413; B05B 11/30; B05B 11/3001
USPC ..... 239/407, 413, 428, 431, 333, 337
See application file for complete search history.

(56) References Cited

U.S. PATENT DOCUMENTS

| | | | | |
|---|---|---|---|---|
| 5,938,116 | A * | 8/1999 | Restive et al. | 239/1 |
| 6,155,498 | A * | 12/2000 | Yamamoto | 239/373 |
| 2001/0025859 | A1* | 10/2001 | Dumont | 222/136 |

FOREIGN PATENT DOCUMENTS

| | | |
|---|---|---|
| BR | 8102945 | 8/2003 |
| BR | PI0603497 | 4/2008 |
| FR | 2 769 247 | 4/1999 |
| WO | 97/25153 | 7/1997 |

* cited by examiner

*Primary Examiner* — Justin Jonaitis
*Assistant Examiner* — Adam J Rogers
(74) *Attorney, Agent, or Firm* — Michael J. Striker

(57) ABSTRACT

A safe portable sprayer comprising a reservoir for storing clean water that can be carried on the back or attached the shoulders, including a large nozzle on the upper face thereof, a small nozzle with a water pump adapted thereto, and a small neck that is provided with a cap. The cap is screwed on the nozzle, and includes a recipient that fits into the nozzle. The cap is provided with vertical holes that pass through a channel. The holes are provided with inner threads for receiving corresponding valves having lower tapered ends. Inside the recipient, flexible containers of chemicals are attached to the holes; the containers are kept immersed and compressed by water inside the recipient from the pump, such that the pressure generated by the water impels the water and chemical toward the channel of the cap, and to the spraying gun through the pipe.

13 Claims, 4 Drawing Sheets

SECTIONAL VIEW A-A

SECTIONAL VIEW A-A

SAFE PORTABLE SPRAYER

DISCLOSURE OF THE INVENTION

The present patent application is directed to a portable sprayer and more particularly a safe portable sprayer.

Chemicals have been formulated for distinct purposes to be used on plants, such as pest control agents, leaf fertilizers, defoliating agents, herbicides, and others.

As is known, chemicals are provided concentrated and the user shall dilute it in water to obtain the broth, or solution, at a suitable concentration for the application thereof. A number of such products are diluted at the rate of one liter of concentrated chemical to 200 liters of water. Most of such products are hazard to living beings (humans, animals) that are exposed to or contacted therewith, even at their maximum dilution rates. There are severe regulations that control the handling and disposal of the packages that contain such products.

A large number of portable sprayers are used in small crops, the chemical recipient thereof being carried on the back of the user or attached to his/her shoulders through a belt.

In such conditions, any leak of the product can reach the cloth, and consequently the user's skin, and thus may cause severe damage to his health. Common occurrences with sprayers, such as a loosen cap, damaged fixture cap, may put the user's life in danger.

It is necessary to follow a number of steps in order to insert the chemical into the sprayer without any risk of infection. The water is poured first, and then a low dose of the chemical from the flask containing it.

After such steps are fulfilled, the sprayer nozzle should be closed and then shaked, and the meter should then be washed. It is necessary to check whether the chemical has not spilled on the sprayer reservoir surface while it was inserted thereto by the meter.

Further, one can mix an amount of water and the chemical in another container in order to feed sprayers with the solution, by using either a tap or a pipe. In this case, the number of contaminants grows a lot, thus requiring additional care.

One of the objects of the present invention is to provide a safe portable sprayer that prevents the user from contacting the chemical, either in the concentrated or diluted form.

Another object of the present invention is to provide a safe portable sprayer that makes it possible to replace one chemical by another one without the need to open the cap.

Still another object of the present invention is to provide a constructive concept of a safe portable sprayer that is provided with a high pressure chamber containing air and clean water.

These and other objects and advantages of the present invention are attained by a safe portable sprayer that comprises a reservoir for storing clean water that can be carried by the user on his back or attached to his shoulders by means of belts connected to the reservoir by straps, said reservoir being provided with a large nozzle on the upper face thereof, a small nozzle with a water pump adapted thereto, and a small neck for feeding water provided with a cap. At least one cap is screwed on the nozzle, so that a recipient that fits into the nozzle and extends as far as the bottom of said reservoir is provided therein. The tightness between the cap, nozzle and recipient is assured by fixtures disposed among them, the cap being provided with a plurality of vertical holes that pass through one same horizontal channel inside the higher wall of the cap. Above the channel, the holes are provided with an inner thread that receives corresponding valves having lower tapered ends for closing the holes below the channel when displaced at the end of their lower courses; flexible squirts containing a concentrated chemical attached to the holes through hydraulic couplers inside the recipient, said squirts being kept immersed and compressed by a body of water inside the recipient which is fed by a pump located beside the recipient and inside the reservoir that is fed with water, so that a repression valve of the pump communicates with the recipient through a pipe, in such a way that the pressure inside the recipient generated by the water pumped from the reservoir impels the water and chemical toward the channel of the cap, thus forming a solution that moves toward a spike, wherein it is connected to the spraying gun through the pipe.

The present invention will be described herein below with reference to the accompanying drawings, wherein.

Figure 1:
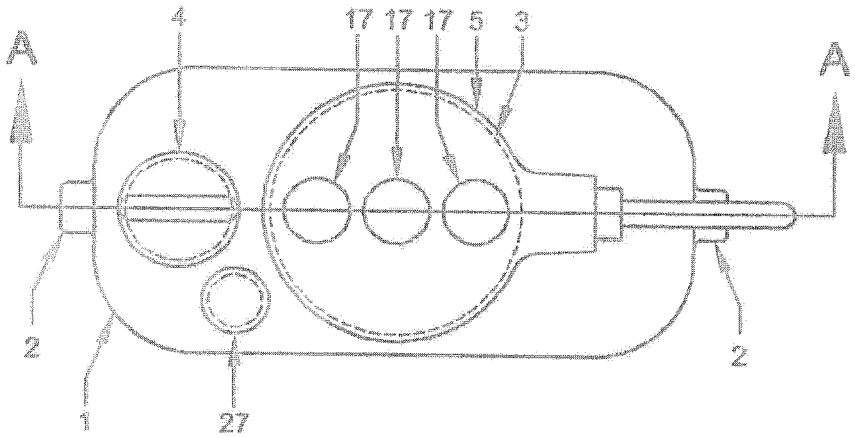
FIG. 1 depicts a top view of the safe portable sprayer object of the present invention.

According to the figures, the safe portable sprayer object of the present invention is comprised of a water reservoir 1 usually made of plastic that the user can carry by attaching it to the back or side of his body by belts that are connected to the reservoir by side or top straps 2.

The reservoir 1 is provided with a large nozzle 3 and a small nozzle 4 nearby on the upper face thereof. The large nozzle 3 has a cap 5 screwed thereon.

Figure 2:
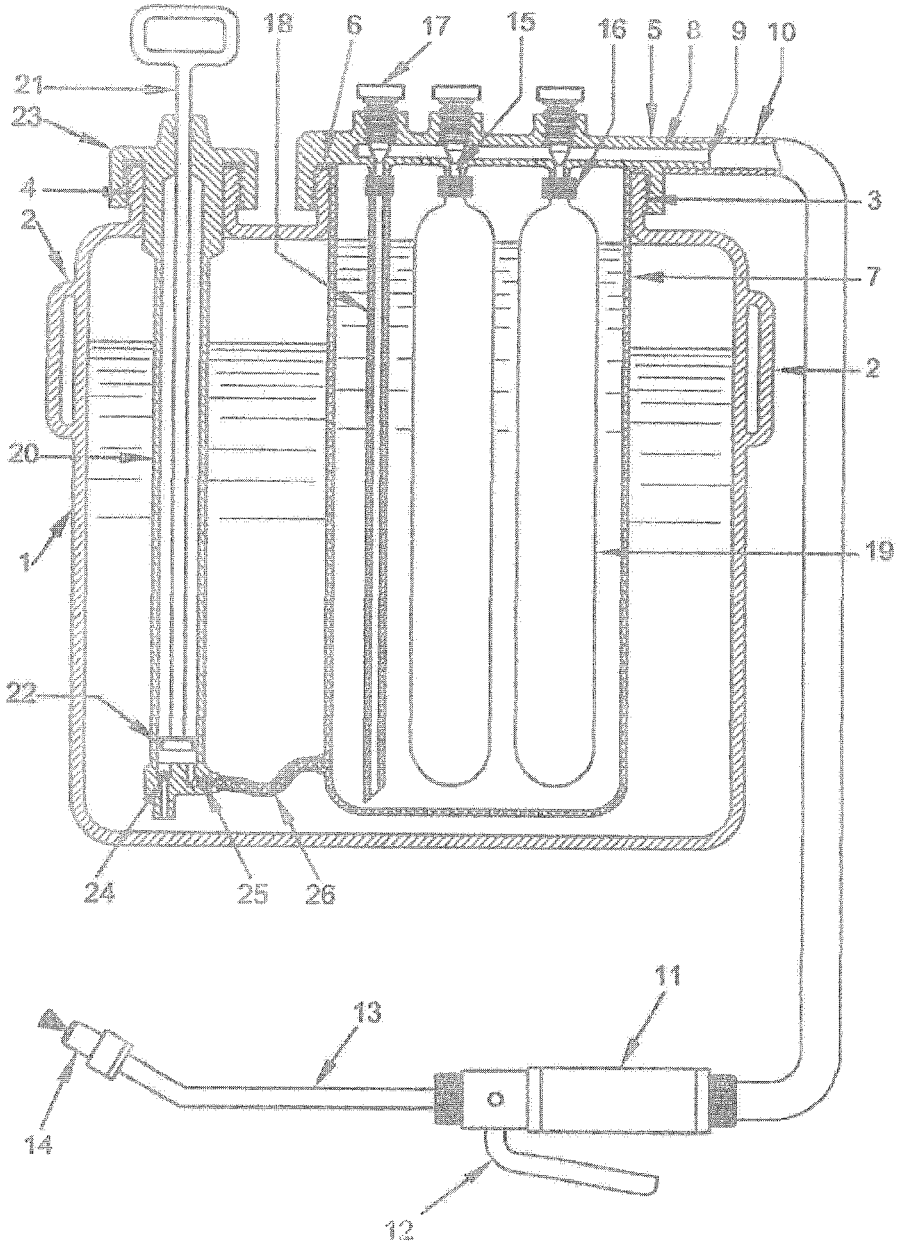
FIG. 2 depicts a vertical section of the safe portable sprayer taken along line A-A of FIG. 1.

A circular rim 6 of a cylindrical recipient 7 that passes through the nozzle hole 3 and extends downward as far as the bottom of the reservoir is disposed on the rim of the nozzle 3 inside the cap 5, see FIG. 2.

The cap 5 has a horizontal channel 8 that is disposed diagonally, one end of which is closed and the other one projects to the side thereof, provided with a spike 9 for receiving a pipe 10 that extends as far as the spraying gun that is provided with a poppet valve 12, a tubular extension 13 and a spraying nozzle 14, also depicted in FIG. 2.

The vertical holes 15 communicate with the channel 8, said holes being provided with a thread above them and hydraulic couplers 16 below them.

Figure 3:
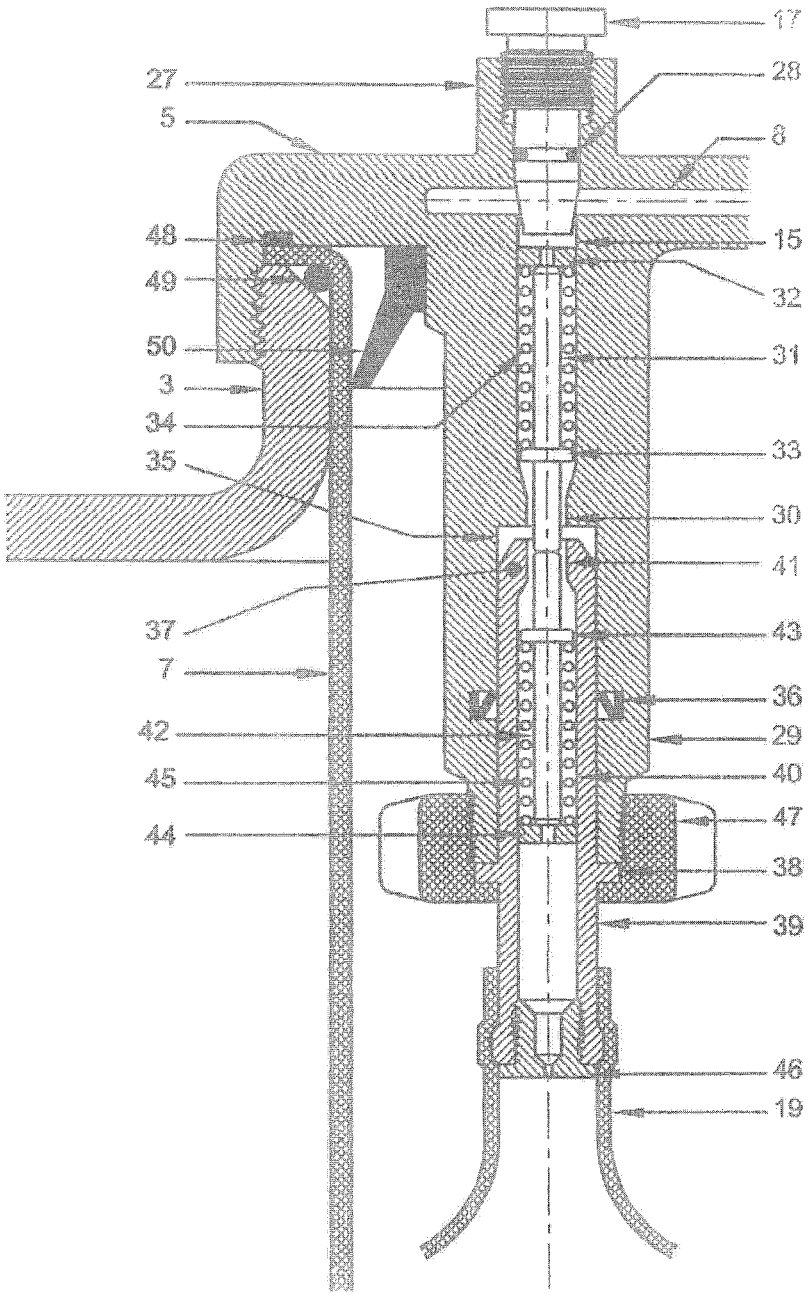
FIG. 3 depicts a vertical section of a detailed amplification of the portion of a valve and a hole with the coupler and the relevant squirt.

The valves 17 that can activate or inactivate the communication of each hole 15 with the channel 8 are screwed on the valves 17, see FIG. 3.

One of the couplers 16 is provided with a tube 18 that extends as far as the bottom of the recipient 7, while each of the other couplers 16 are provided with a flexible squirt 19 containing concentrated chemical, see FIG. 2.

As can be seen in FIGS. 1 and 2, a water pump 20 having a piston that is embedded into the small nozzle 4 extends downward as far as the bottom of the reservoir 1. The rod 21 of the piston 22 projects upward, where a cap 23 is screwed on the nozzle 4. Two aspiration and repression valves 24 and 25, respectively, are assembled to the lower portion, the latter communicating with the recipient 7 by a pipe 26.

When the sprayer is propelled by an electric or gas-powered engine, the piston pump can be dispensed, and then the engine propelled hydraulic pump sucks the water from the reservoir 1 and compresses it in the recipient 7.

Each flexible squirt 19 containing the chemical is sealed by the manufacturer. The coupler 16 is able to activate the communication between the squirt 19 and the hole 15 of the cap 5.

When the squirt 19 is removed, the coupler 16 is closed and then the hole 15 is closed accordingly.

Since the reservoir 1 is filled with clean water, it should only be provided with a small neck with the cap 27 for inserting the water, as can be seen in FIG. 1.

A possible embodiment of the coupler 16 is shown in FIG. 3. The cap 5 is provided with cylindrical protuberances 27 on the upper portion thereof, so that the valves 17 can be screwed on it and are provided with a groove and sealing ring 28, ending in a tapered portion that fits into the hole 15 right below the channel 8.

Each hole 15 extends downward on the lower face of the cap towards the center of the cylindrical protuberance 29 the lower end of which is provided with an inner thread. The hole 15 is provided with a narrowing 30 half way the protuberance 29. A pin 31 that protrudes a little below the narrowing 30 and extends upward as far as a bushing 32 is imbedded into the hole 15. The pin 31 is provided with a circular widening 33 near the narrowing 30 and right above it, so that the hole 15 is blocked when the pin goes down and contacts the narrowing 30. A helical spring 34 is wrapped around the upper portion of the pin 31, is disposed on the punctured bushing 32 and the widening 33, and then pushes the pin 31 down, thus forcing it to block the hole 15.

Below the narrowing 30, the cylindrical protuberance 29 is provided with a concentric parallel hole 35 having a diameter that is higher than the upper portion of the hole 15, said hole being provided with a ring-shaped fixture 36. A cylindrical hollow pin 37 with a slightly tapered tip fits into the hole 35 and is assembled close to the narrowing 30 of the hole 31, said pin 37 being provided with a circular rim 38 on the lower portion thereof that contacts with the lower portion of the protuberance 29, said pin 37 also being provided with an extension 39 that acts as a spike for the neck of the squirt 19.

The hollow portion of the pin 37 is a cylindrical concentric hole 40 the upper portion of which has a narrowing 41 for receiving a pin 42 similar to the pin 31 that is provided with a circular protuberance 43, said pin 42 extending downward as far as a bushing attached to the hole 40. A helical spring 45 is wrapped around the pin 42, disposed on the punctured bushing 44 and presses the circular protuberance upwards so that it can block the narrowing 41.

A plug 46 having a metered through-hole for dosing the chemical that is expelled from the squirt 19 by the inner pressure it is subjected to is screwed on or embedded into the lower portion of the hole 40.

The pin 37 is attached to the protuberance 29 of the cap 5 through a nipple 47 that supports the rim 38 internally and is screwed on the protuberance 29.

When fully screwed, the nipple 47 makes it possible for a fluid to flow through holes 40 and 15, since the pins 31 and 42 touch each other and are mutually pushed so that their protuberances 33 and 43 move away from the respective narrowings 30 and 41. In this situation, the pins 31 and 42 contact the bushings 32 and 44 that will assure that both passages are opened even when one of the springs 34 or 45 is stronger than the other one, thus creating a fluid communication in the holes 15, 35, and 40.

While the pin 37 is being inserted into the hole 35 of the protuberance 29, a fixture 36 creates a tight connection even before the pins 31 and 42 touch each other. This is also valid while the pin 37 is being removed, when the seal provided by the fixture 36 is maintained until the upper and lower holes 15 and 35 are fully closed.

The assembly formed by the pin 37, the nipple 47 and the squirt 19 are usually delivered by the manufacturer. For storage and transportation purposes, the manufacturer can adapt a capsule screwed on the nipple, thus wrapping and protecting the pin 37.

The pins 31 and 42 provide a positive seal that increases when the pressure is increased, thus preventing eventual leaks.

Figure 4:
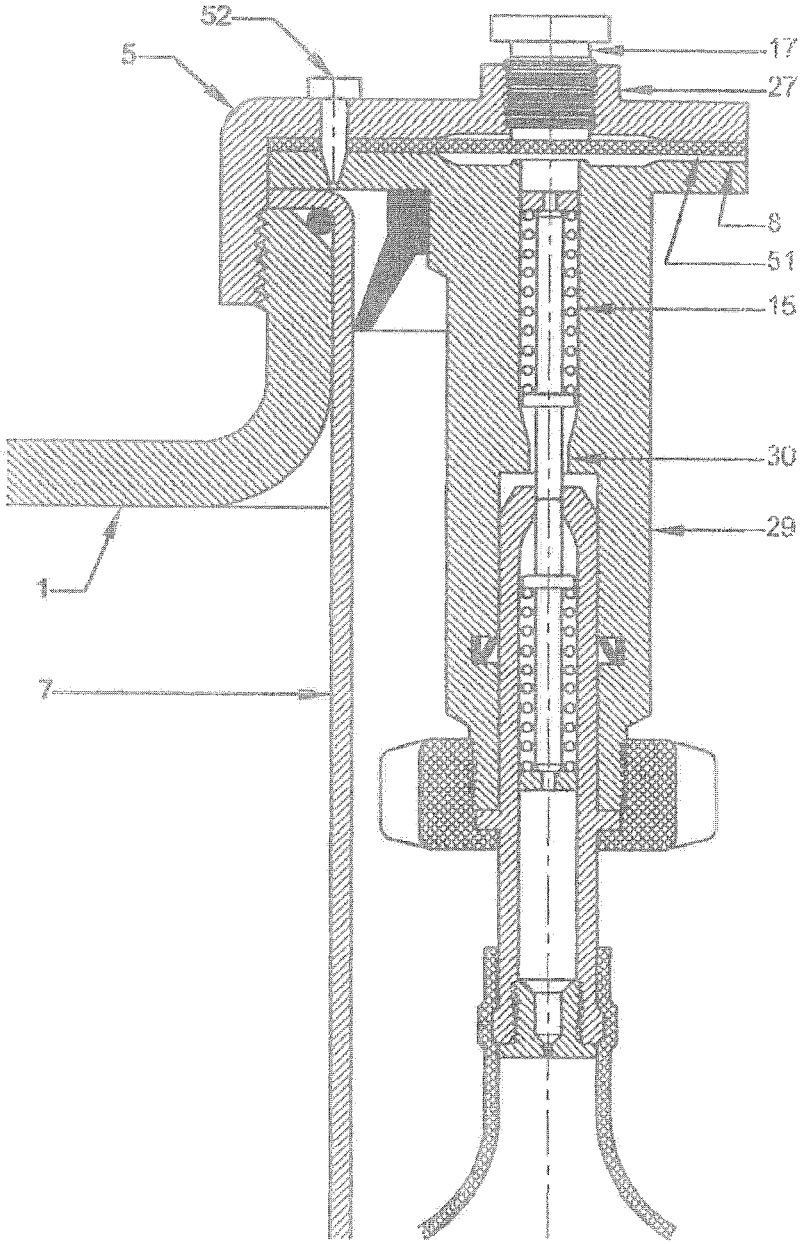
FIG. 4 depicts a vertical section of a detailed amplification of the cap, with an alternate valve for opening and closing the hole.

As can be seen in FIGS. 3 and 4, the cap 5 can receive a fixture 48 above the rim 6 of the recipient 7, a fixture 49 below the rim, as well as a fixture 50 in contact with the inner cylindrical portion of the recipient 7.

A constructive alternative of valves is specifically depicted in FIG. 4, wherein the holes 15 are sealed by a pressure on a diaphragm 51. In this case, the cap 5 is horizontally divided into two parts with the diaphragm between same, which parts are attached to each other by bolts 52 or rivets. The valve 17 only pushes the diaphragm downwards against the edge of the hole 15, thus closing it. When the chemical can not leak above the diaphragm any longer, the valve 17 does not require the sealing ring 28 any more. The channel 8 is formed below the diaphragm 51 and leaves the cap 5 through the spike 9.

Other configurations and constructive forms may be applied to the couplers 16 in order to fulfill the communication between the squirts 19 and the holes 15 that join with the channel 8 toward the pipe 10 and the gun 11 and shall keep the holes 15 and the squirts 19 tight when they are not coupled within the scope of the present invention.

The cap 5 can either have a coupler 16 for only one squirt 19 or two, three or more couplers 16 for receiving the squirts 19 containing different chemicals as selected by the user.

The invention claimed is:

1. A safe portable sprayer with a reservoir (1) for storing clean water that can be carried by the user on his back or attached to his shoulders by belts connected to the reservoir by straps, the reservoir comprising:

a large nozzle (3) on an upper face of the reservoir including threads formed on an outer cylindrical surface, a small nozzle (4) with a water pump (20) adapted to the small nozzle, and a small neck for feeding water provided with a first cap (27), wherein a second cap (5) having threads formed on an outer cylindrical surface comprising a lower wall of the second cap is screwed on the large nozzle (3), so that a recipient (7) that fits into the large nozzle (3) and extends as far as a bottom of the reservoir (1) is provided therein;

wherein a tightness between the second cap (5), the nozzle (3) and the recipient (7) is assured by fixtures (48, 49, 50) disposed therebetween, wherein the second cap (5) is provided with a plurality of vertical holes (15) that pass through a horizontal channel (8) inside a higher wall of the cap (5);

wherein the holes (15) are provided above the channel (8) with an inner thread that receives corresponding valves (17) having lower tapered ends for closing the holes (15) below the channel (8) when displaced at an end of a lower course of the valves;

wherein flexible containers (19) inside the recipient (7) are configured for containing a concentrated chemical attached to the holes (15) through hydraulic couplers (16) and are kept immersed and compressed by a body of water inside the recipient (7) which is fed by the pump (20) located beside the recipient (7) and inside the reservoir (1), and wherein a repression valve (25) of the pump (20) communicates with the recipient (7) through a pipe (26), in such a way that a pressure inside the recipient (7) generated by the water pumped from the reservoir (1) impels the water and chemical towards the channel (8) of the second cap (5), thus forming a solution that moves toward a spike (9), where the channel (8) is connected to the spraying gun (11) through the pipe (10).

2. The safe portable sprayer according to claim 1, wherein a circular rim (6) of the cylindrical recipient (7) is positioned on the rim of the large nozzle (3) inside the second cap (5), the second cap (5) provided with the horizontal channel (8) that is disposed diagonally and interconnected laterally with the spike (9) for receiving the pipe (10) that extends as far as the spraying gun (11) that is provided with a poppet valve (12), a tubular extension (13) and a spraying nozzle (14).

3. The safe portable sprayer according to claim 1, wherein one of the hydraulic couplers (16) is provided with a tube (18) that extends as far as the bottom of the recipient (7), while each of the other couplers(16) receives a corresponding flexible container (19) containing a concentrated chemical.

4. The safe portable sprayer according to claim 1, wherein the water pump (20) is of the piston type and extends downwards as far as the bottom of the reservoir (1) in such a way that a the rod (21) of the piston (22) protrudes upward, where a third cap (23) is screwed on the small nozzle (4); and wherein two aspiration and repression valves (24, 25), respectively, are assembled on a lower portion of the small nozzle (4), which communicates with the recipient (7) by a pipe (26).

5. The safe portable sprayer according to claim 1, wherein the pump (20) is of the hydraulic type and powered by sucking water from the reservoir (1) and pressing same in the recipient (7).

6. The safe portable sprayer according to claim 1, wherein the second cap (5) is provided with cylindrical protuberances (27) on an upper portion thereof where the externally threaded valves (17) are housed, the second cap also provided with a groove and sealing ring (28) and ending in a tapered portion that fits into the hole (15) right below the channel (8).

7. The safe portable sprayer according to claim 1, wherein each hole (15) extends downward on the lower face of the second cap (5) towards a center of the cylindrical protuberance (29) the lower end of which is provided with an inner thread; wherein the hole (15) is provided with a narrowing (30) half way to the protuberance (29), and houses in an upper portion a first pin (31) that protrudes a little below the narrowing (30) and extends upward as far as a bushing (32); wherein the first pin (31) is provided with a circular widening (33) near the narrowing (30) and just above the narrowing, so that the hole (15) is blocked when the first pin goes down and contacts the narrowing (30); and wherein a helical spring (34) that is wrapped around an upper portion of the first pin (31) between the punctured bushing (32) and the widening (33) pushes the first pin (31) down, thus forcing the first pin (31) to block the hole (15).

8. The safe portable sprayer according to claim 1, wherein the cylindrical protuberance (29) below the narrowing (30) is provided with a concentric parallel hole (35) having a diameter that is higher than a diameter of the upper portion of the hole (15) that is provided with a ring-shaped fixture (36); wherein a cylindrical hollow second pin (37) with a slightly tapered tip is embedded into the hole (35) and assembled close to the narrowing (30) of the hole (31), the second pin (37) provided with a circular rim (38) on a lower portion thereof that contacts with a lower portion of the protuberance (29), the second pin (37) also provided with an extension (39) that acts as a neck spike for the neck of the container (19).

9. The safe portable sprayer according to claim 1, wherein the hollow portion of the second pin (37) is a cylindrical concentric hole (40) the upper portion of which having a narrowing (41) for receiving a third pin (42) that is provided with a circular protuberance (43) that extends downward as far as a bushing (44) attached to the hole (40); wherein a helical spring (45) that is disposed on the punctured bushing (44) is wrapped around the third pin (42) and presses the circular protuberance upward so that it can block the narrowing (41).

10. The safe portable sprayer according to claim 1, wherein a plug (46) having a metered through-hole is screwed on or embedded into the lower portion of the hole (40); and wherein the second pin (37) is attached to the protuberance (29) of the second cap (5) through a nipple (47) that supports the rim (38) internally and is screwed on the protuberance (29).

11. The safe portable sprayer according to claim 1, wherein, alternately, the holes (15) are sealed by a pressure on a diaphragm (51), the second cap (5) in this case is horizontally divided into two parts with the diaphragm (51) between same, which two parts are attached to each other by bolts (52) or rivets in such a way that the valve (17) only pushes the diaphragm downward against the edge of the hole (15), thus closing it.

12. The safe portable sprayer according to claim 1, wherein the cap (5) has either a coupler (16) for only one container (19) or two, three or more couplers (16) for receiving the containers (19) containing different chemicals as selected by the user.

13. A safe portable sprayer with a reservoir (1) for storing clean water that can be carried by the user on his back or attached to his shoulders by belts connected to the reservoir by straps, the reservoir comprising:

a large nozzle (3) on an upper face of the, a small nozzle (4) with a water pump (20) adapted to the small nozzle, and a small neck for feeding water provided with a first cap (27), wherein a second cap (5) is screwed on the large nozzle (3), so that a recipient (7) that fits into the large nozzle (3) and extends as far as a bottom of the reservoir (1) is provided therein;

wherein a tightness between the second cap (5), the nozzle (3) and the recipient (7) is assured by fixtures (48, 49, 50) disposed therebetween, wherein the second cap (5) is provided with a plurality of vertical holes (15) that pass through a horizontal channel (8) inside a higher wall of the cap (5);

wherein the holes (15) are provided above the channel (8) with an inner thread that receives corresponding valves (17) having lower tapered ends for closing the holes (15) below the channel (8) when displaced at an end of a lower course of the valves;

wherein flexible containers (19) inside the recipient (7) are configured for containing a concentrated chemical attached to the holes (15) through hydraulic couplers (16) and are kept immersed and compressed by a body of water inside the recipient (7) which is fed by the pump (20) located beside the recipient (7) and inside the reservoir (1), wherein repression valve (25) of the pump (20) communicates with the recipient (7) through a pipe (26), in such a way that a pressure inside the recipient (7) generated by the water pumped from the reservoir (1) impels the water and chemical towards the channel (8) of the second cap (5), thus forming a solution that moves toward a spike (9), where the channel (8) is connected to the spraying gun (11) through the pipe (10), wherein the cylindrical protuberance (29) below the narrowing (30) is provided with a concentric parallel hole (35) having a diameter that is higher than a diameter of the upper portion of the hole (15) that is provided with a ring shaped fixture (36); and wherein a cylindrical hollow second pin (37) with a slightly tapered tip is embedded into the hole (35) and assembled close to the narrowing (30) of the hole (31), the second pin (37) provided with a circular rim (38) on a lower portion thereof that contacts with a lower portion of the protuberance (29), the second pin (37) also provided with an extension (39) that acts as a neck spike for the neck of the container (19).

* * * * *